US006911422B1

(12) United States Patent
Song et al.

(10) Patent No.: US 6,911,422 B1
(45) Date of Patent: Jun. 28, 2005

(54) TRANSPARENT OR TRANSLUCENT, LIQUID OR GEL TYPE AUTOMATIC DISHWASHING DETERGENT PRODUCT

(75) Inventors: Brian Xiaoqing Song, West Chester, OH (US); Peter Robert Foley, Cincinnati, OH (US); Melissa Dee Aquino, Ft. Collins, CO (US)

(73) Assignee: The Procter & Gamble Company, Cincinnati, OH (US)

( * ) Notice: Subject to any disclaimer, the term of this patent is extended or adjusted under 35 U.S.C. 154(b) by 351 days.

(21) Appl. No.: 10/019,175

(22) PCT Filed: Jun. 30, 2000

(86) PCT No.: PCT/US00/18070

§ 371 (c)(1),
(2), (4) Date: Oct. 21, 2002

(87) PCT Pub. No.: WO01/02531

PCT Pub. Date: Jan. 11, 2001

Related U.S. Application Data

(60) Provisional application No. 60/141,932, filed on Jul. 1, 1999.

(51) Int. Cl.[7] ..... C11D 7/06

(52) U.S. Cl. ..... 510/220; 510/221; 510/225; 510/233; 510/147

(58) Field of Search ..... 510/220, 221, 510/225, 233, 147

(56) References Cited

U.S. PATENT DOCUMENTS

| | | | | |
|---|---|---|---|---|
| 3,583,922 A | | 6/1971 | McClain et al. | |
| 3,715,314 A | | 2/1973 | Morganstern | |
| 4,051,056 A | | 9/1977 | Hartman | |
| 4,201,687 A | | 5/1980 | Crutchfield et al. | |
| 4,228,043 A | | 10/1980 | Van Den Brom | |
| 4,233,173 A | | 11/1980 | Mayer et al. | |
| 4,257,908 A | | 3/1981 | Wixon | |
| 4,279,764 A | | 7/1981 | Brubaker | |
| 4,933,101 A | * | 6/1990 | Cilley et al. | 510/222 |
| 4,992,209 A | | 2/1991 | Smyk et al. | |
| 5,047,164 A | | 9/1991 | Corby | |
| 5,213,706 A | | 5/1993 | Rapisarda et al. | |
| 5,384,061 A | * | 1/1995 | Wise | 510/223 |
| 5,413,727 A | | 5/1995 | Drapier et al. | |
| 5,431,839 A | | 7/1995 | Guillou | |
| 5,470,499 A | | 11/1995 | Choy et al. | |

FOREIGN PATENT DOCUMENTS

| | | |
|---|---|---|
| CA | 860279 | 1/1971 |
| GB | 1 489 867 | 10/1977 |
| GB | 1 577 140 | 10/1980 |
| JP | 63-108099 | 5/1988 |
| JP | 63-161088 | 7/1988 |
| WO | WO 97/43392 | 11/1997 |

* cited by examiner

*Primary Examiner*—Charles Boyer
(74) *Attorney, Agent, or Firm*—Kevin L. Waugh; Steven W. Miller

(57) ABSTRACT

A process of imparting transparency or translucency to a liquid or gel type automatic dishwashing detergent product is disclosed. The process includes the steps of providing a liquid or gel type automatic dishwashing detergent composition expressly free from (i) potassium tripolyphosphate and (ii) mixture of sodium tripolyphosphate and potassium tripolyphosphate, adding one or more of potassium sources to the liquid or gel type automatic dishwashing detergent composition, the potassium sources being expressly free of potassium tripolyphosphate, and maintaining a K:Na weight ratio greater than at least about 0.5:1.

10 Claims, No Drawings

TRANSPARENT OR TRANSLUCENT, LIQUID OR GEL TYPE AUTOMATIC DISHWASHING DETERGENT PRODUCT

This application claims the benefit of Provisional Application No. 60/141,932 filed Jul. 1, 1999.

TECHNICAL FIELD

The present invention relates to liquid or gel type automatic dishwashing detergent compositions. More particularly, the invention relates to a process of imparting transparency or translucency to a liquid or gel type automatic dishwashing detergent product and a transparent or translucent a liquid or gel type automatic dishwashing detergent product having one or more potassium sources to maintain pre-selected potassium:sodium ratios in order to make the composition transparent or translucent while at the same time not using any (i) potassium tripolyphosphate or (ii) mixtures of sodium and potassium tripolyphosphate.

BACKGROUND OF THE INVENTION

Improving the aesthetics of a liquid or gel type automatic dishwashing detergent product (liquid/gel ADW or liqui-gel ADW) is believed to be a very important aspect of this product Typically, consumers of liquid ADW products have a preference for liquid ADW products having a certain color or appearance. The addition of a transparent or translucent characteristics to a liquid ADW composition can improve the desirability of the product because of a transparent or translucent product has a shiny appearance which is liked by consumers. Also, a transparent or translucent product allows for suspension of colored prills into that product, which can further enhance the physical appearance of the product. The transparent product may be clear, or dyed, using dyes that do not cause significant staining or dyeing of plastics during the wash cycle in automatic dishwashing.

In the low-free water environment of a typical phosphate containing gel type ADW composition, it is a real challenge to obtain clear or translucent characteristics. This is primarily due to the relatively low solubility of commodity phosphate builders, such as sodium tripolyphosphate (STPP), which has a solubility typically of about 14.5 grams per 100 cc of water at room temperature. Previous formulators wishing to obtain clear or translucent characteristics in a liquid or gel type ADW have been forced to use highly soluble potassium tripolyphosphate (KTPP), or alternatively, commercially available mixtures of sodium tripolyphosphate and potassium tripolyphosphates (commonly referred to as SKTPP) which have heretofore served a dual purpose of being a potassium source (for transparency/translucency) and a phosphate source (for cleaning performance). The use of KTPP and SKTPP is generally considered undesirable for various reasons, one of them being the economics of manufacturing. Alternatively, the previous formulators have been forced to use very low levels of KTPPs or SKTPs, which detrimentally affects cleaning performance. Thus, a considerable effort has been directed in this field, to develop novel solutions for attaining transparency and/or translucency in liqui-gel ADWs.

It has been desirable to have a liqui-gel ADW product having transparency and/or translucency characteristics, but without using (i) potassium tripolyphosphate (KTPP), and/or (ii) commercially available mixtures of sodium tripolyphosphate and potassium tripolyphosphate (SKTPP), while at the same time still maintaining high phosphate levels so as to not detrimentally affect cleaning performance.

The inventors of the present invention have discovered that by maintaining a K:Na weight ratio greater than at least about 0.5:1, K:Na, outstanding translucent characteristics can be imparted without having to use KTPP or SKTPP. Thus, high phosphate levels can be attained by the addition of sodium tripolyphosphate (STPP) alone, along with the addition of potassium hydroxide (KOH) for obtaining high alkalinity or the addition of other sources of potassium for obtaining moderate alkalinity.

The present invention is thus directed to overcome one or more of the problems as set forth before.

SUMMARY OF THE INVENTION

The invention meets the needs above by providing a process of imparting transparency or translucency to a liquid or gel type automatic dishwashing detergent product, and a transparent or translucent a liquid or gel type automatic dishwashing detergent product.

In one aspect of the present invention, the process of imparting transparency or translucency to a liquid or gel type automatic dishwashing detergent product comprises the steps of providing a liquid or gel type automatic dishwashing detergent composition expressly free from (i) potassium tripolyphosphate and (ii) mixture of sodium tripolyphosphate and potassium tripolyphosphate, adding one or more of potassium sources to the liquid or gel type automatic dishwashing detergent composition, the potassium sources being expressly free of potassium tripolyphosphate, and maintaining a potassium:sodium weight ratio greater than at least about 0.5:1.

In another aspect of the present invention, the transparent or translucent a liquid or gel type automatic dishwashing detergent product comprises a liquid or gel type automatic dishwashing detergent composition. The composition is expressly free from (i) potassium tripolyphosphate and (ii) mixture of sodium tripolyphosphate and potassium tripolyphosphate. The composition includes one or more of potassium sources, the potassium sources being expressly free of potassium tripolyphosphate. The potassium:sodium weight ratio is greater than at least about 0.5:1.

DETAILED DESCRIPTION OF THE INVENTION

In the preferred embodiment of the present invention, the process of imparting transparency or translucency to a liquid or gel type automatic dishwashing detergent product comprises the steps of providing a liquid or gel type automatic dishwashing detergent composition expressly free from KTPP and SKTPP.

Express Exclusion of KTPP and SKTPP

In the preferred embodiment, the liquid or gel type automatic dishwashing detergent composition is expressly free of KTPP and SKTPP. The abbreviation KTPP as used herein means potassium tripolyphosphate, as is commercially available, which may contain incidental and/or trace impurities of other tripolyphosphates, such as STPP. The abbreviation SKTPP, as used herein means commercially available mixtures of STPP and KTPP, wherein the weight ratio of Na;K is more than 95:5.

Potassium Sources

The process further includes the step of adding one or more of potassium sources to the liquid or gel type automatic dishwashing detergent composition, the potassium sources being expressly free of potassium tripolyphosphate. In the preferred embodiment of the present invention, the potassium source is KOH, added in an amount desirably in a range of from about 4% to about 20% by weight of the detergent composition and preferably in a range of from about 8% to about 15% by weight of the detergent composition. When KOH is the preferred potassium source, the liquid or gel type automatic dishwashing detergent composition has a pH desirably of at least about 9, and preferably, in a range of from about 11 to about 12.5. For purposes of this disclosure, the term pH, as used herein means pH of a 1% solution of liquid ADW composition in water by weight. Alternatively, the potassium source is selected from the group consisting of $K_2SO_4$, $KNO_3$, $K_2CO_3$, KCl, KBr, $K_3PO_4$, potassium silicate, potassium acetate, or mixtures thereof. When the potassium source is selected from the aforementioned group, it is added in an amount desirably in a range of from about 2% to about 20% by weight of the detergent composition and preferably in a range of from about 5% to about 16% by weight of the detergent composition, depending upon the availability of K in the potassium source on a molar basis. When the potassium source is selected from the aforementioned group, the liquid or gel type automatic dishwashing detergent composition has a pH of at least about 6.5. The lower pH values are preferred when formulating the detergent composition with enzymes, which may be present in the liqui-gel composition in a liquid form or in the form of solid prills that are coated with a permeable or impermeable coating.

K:Na Weight Ratio

The process further includes the step of maintaining a potassium:sodium weight ratio desirably greater than about 0.5:1, and preferably above 0.65:1. In a more preferred embodiment, the K:Na weight ratio is desirably maintained in a range of from about 0.5:1 to about 1.25:1, particularly when the detergent composition has a total solids content of less than about 20% by weight. Preferably, the potassium: sodium weight ratio is maintained at least greater than 0.75:1, and more preferably, in a range of from about 0.75:1 to about 2:1, potassium:sodium, particularly when the liquid or gel type automatic dishwashing detergent composition has a total solids content in a range of from about 20% to about 40% by weight. The total solids content comprises solids in the form of STPP, i.e., the phosphate builder, which is typically present in an amount in a range of about 10% to 40%, thickener, such as a polymer, and potassium hydroxide, i.e., one of the potassium sources. It should be noted that other optional ingredients may also make up the total solids content in a liqui-gel ADW composition.

Phosphate Builder

The liquid or gel type automatic dishwashing detergent composition provided in this process, further includes a phosphate builder in an amount desirably in a range of from about 10% to about 40% of said detergent composition, and preferably in a range of from about 12% to about 30% of said detergent composition. The preferred phosphate builder useful in practicing this invention is sodium tripolyphosphate (STPP). The STPP is essentially free of any KTPP, other than what may be present in trace quantities as naturally occurring impurity or an impurity during the commercial manufacturing of STPP. Other phosphate builders known to those skilled in the art may also be utilized in lieu of or in conjunction with STPP.

In another embodiment of the present invention, a transparent or translucent a liquid or gel type automatic dishwashing detergent product includes a liquid or gel type automatic dishwashing detergent composition. The composition is expressly free of KTPP and SKTPP. The composition includes one or more of potassium sources, the potassium sources being expressly fee of KTPP. The potassium:sodium weight ratio is desirably greater than about 0.5:1.

Other Ingredients (a) Thickeners

The physical stability of the liquid product may be improved and the thickness of the liquid product may be altered by the addition of a cross linking polyacrylate thickener to the liquid detergent product as a thixotropic thickener.

(b) pH Adjusting Components

The above liquid automatic dishwashing detergent product is preferably low foaming, readily soluble in the washing medium and most effective at pH values best conducive to improved cleaning performance, such as in a range of desirably from about pH 6.5 to about pH 12.5, and preferably from about pH 8.0 to about pH 12.0, more preferably from about pH 8.5 to about pH 12.5. The pH adjusting components are desirably selected from sodium or potassium hydroxide, sodium or potassium carbonate or sesquicarbonate, sodium or potassium silicate, boric acid, sodium or potassium bicarbonate, sodium or potassium borate, and mixtures thereof. NaOH or KOH are the preferred ingredients for increasing the pH to within the above ranges. Other preferred pH adjusting ingredients are sodium carbonate, potassium carbonate, and mixtures thereof.

(c) Low Foaming Surfactant

The liquid nonionic surfactant detergents that can be used to practice the present invention are preferably are alkyl ethoxylates in non-chlorine bleach liquid ADW compositions. One example of a non-chlorine bleach stable surfactant is SLFI 8® manufactured by BASF Corporation. Alternatively, in chlorine bleach containing liquid ADW compositions, chlorine bleach stable low foaming surfactants are preferred and such surfactants are present in a range of from about 0.1% to about 10% by weight of the liquid composition. Such surfactants are generally known to one skilled in the art and need not be elaborated here, for purposes of brevity. An example of a chlorine bleach stable surfactant is Dowfax® anionic surfactant available from the Dow Chemical Company.

(d) Enzymes

Enzymes may be present in the liqui-gel composition in the form of liquid enzymes when the pH of the liquid ADW is less than about 10.0 At pH's greater than about 10.0, enzymes in the form of solid prills that are coated with impermeable or permeable coating may be used. Various types of enzymes are well known to those skilled in the art, such as proteases and amylases, both of which are useful in carrying out this invention.

(e) Other Adjunct Ingredients

The liquid automatic dishwashing detergent composition may optionally contain up to about 20% of a dispersant polymer selected from the group consisting of polyacrylates and polyacrylate copolymers.

To exemplify various embodiments of the present invention, Samples A, B and C of the liquid automatic dishwashing detergent product composition are formulated using the below named ingredients, as set forth in Example A.

EXAMPLE A

| Ingredient (weight % active) | Sample A | Sample B | Sample C |
|---|---|---|---|
| Sodium Tripolyphosphate | 16.0 | 16.0 | 16.0 |
| Potassium Tripolyphosphate | 0.0 | 0.0 | 0.0 |
| Sodium Silicate | 0.0 | 0.0 | 0.5 |
| Potassium hydroxide | 0.0 | 11.0 | 11.0 |

-continued

| Ingredient (weight % active) | Sample A | Sample B | Sample C |
|---|---|---|---|
| Sodium hydroxide | 0.0 | 0.0 | 0.0 |
| Polyacrylate polymer | 0.0 | 0.0 | 1.0 |
| Nitric Acid | 0.012 | 0.0 | 0.0 |
| Perfume | 0.03 | 0.03 | 0.03 |
| Nonionic surfactant | 0.3 | 0.5 | 0.5 |
| Polyacrylate polymer thickener | 1.5 | 1.0 | 1.0 |
| Protease enzyme | 0.5 (liquid) | 1.0 (prill) | 1.0 (prill) |
| Amylase enzyme | 0.7 (liquid) | 1.0 (prill) | 1.0 (prill) |
| propylene glycol | 4.0 | 0.0 | 0.0 |
| sodium borate | 4.0 | 0.0 | 0.0 |
| Potassium sulfate | 16.0 | 0.0 | 0.0 |
| Water | Bal. | Bal. | Bal. |
| TOTAL | 100.0 | 100.0 | 100.0 |
| pH | 8.5 | 12.1 | 12.1 |

Accordingly, having thus described the invention in detail, it will be obvious to those skilled in the art that various changes may he made without departing from the scope of the invention and the invention is not to be considered limited to what is described in the specification.

What is claimed is:

1. A process of imparting transparency or translucency to a liquid or gel type automatic dishwashing detergent product, characterized by the steps of:

providing a liquid or gel type automatic dishwashing detergent composition expressly free from (i) potassium tripolyphosphate and (ii) mixture of sodium tripolyphosphate and potassium tripolyphosphate;

adding one or more of potassium sources to said liquid or gel type automatic dishwashing detergent composition, said potassium sources being expressly free of potassium tripolyphosphate; and maintaining a potassium:sodium weight ratio greater than at least 0.5:1.

2. A transparent or translucent, liquid or gel type automatic dishwashing detergent product, said product comprises:

a) a liquid or gel type automatic dishwashing detergent composition, said composition being free from potassium tripolyphosphate, sodium tripolyphosphate, potassium tripolyphosphate, and mixtures thereof;

b) one or more of potassium sources to said liquid or gel type automatic dishwashing detergent composition, said potassium sources being free of potassium tripolyphosphate; and c) a potassium:sodium weight ratio greater than at least about 0.5:1.

3. The method according to claim 2, wherein said potassium source is selected from the group consisting of $K_2SO_4$, $KNO_3$, $K_2CO_3$, KCl, KBr, $K_3PO_4$, potassium silicate, potassium acetate, and mixtures thereof.

4. The method according to claim 2, wherein said potassium source is KOH.

5. The method according to claim 2, wherein said potassium source is added in an amount in a range of from about 2% to about 20% by weight of said liquid or gel type detergent composition.

6. The method according to claim 2, wherein said liquid or gel type detergent composition has a pH of less than about 6.5.

7. The method according to claim 2, wherein said liquid or gel type automatic dishwashing detergent composition includes a phosphate builder in an amount in a range from about 10% to about 40% of said detergent composition.

8. The method according to claim 2, wherein said potassium:sodium weight ratio is maintained in an amount greater than about 0.65:1.

9. The method according to claim 2, wherein said liquid or gel type automatic dishwashing detergent composition has a total solids content of less than about 20% by weight.

10. The method according to claim 2, wherein said liquid or gel type automatic dishwashing detergent composition has a total solids content a range of from about 20% to 40% by weight.

* * * * *